US011781259B2

(12) United States Patent
Pazzin Curiel et al.

(10) Patent No.: US 11,781,259 B2
(45) **Date of Patent: *Oct. 10, 2023**

(54) LAUNDRY TREATING APPLIANCE WITH REMOVABLE BASKET

(71) Applicant: WHIRLPOOL CORPORATION, Benton Harbor, MI (US)

(72) Inventors: Joao Arthur Pazzin Curiel, Rio Claro (BR); Dailor Moreno Barberis Alves Lima, Rio Claro (BR); Fernando Raiss Martins, Rio Claro (BR); Mauro R. Ushizima, Rio Claro (BR); Eduardo Luis Violin, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/502,603

(22) Filed: Oct. 15, 2021

(65) Prior Publication Data

US 2022/0034013 A1 Feb. 3, 2022

Related U.S. Application Data

(63) Continuation of application No. 16/713,041, filed on Dec. 13, 2019, now Pat. No. 11,168,428, which is a (Continued)

(51) Int. Cl.

| | |
|---|---|
| ***D06F 29/00*** | (2006.01) |
| ***D06F 95/00*** | (2006.01) |
| ***D06F 37/24*** | (2006.01) |
| ***D06F 39/08*** | (2006.01) |
| ***D06F 23/04*** | (2006.01) |
| ***D06F 39/02*** | (2006.01) |

(Continued)

(52) U.S. Cl.

CPC ..... *D06F 29/00* (2013.01); *D06F 37/24* (2013.01); *D06F 39/02* (2013.01); *D06F 95/002* (2013.01); *D06F 13/00* (2013.01); *D06F 23/00* (2013.01); *D06F 23/04* (2013.01); *D06F 39/00* (2013.01); *D06F 39/083* (2013.01)

(58) Field of Classification Search

CPC ..... D06F 37/24; D06F 37/245; D06F 39/00; D06F 39/02; D06F 39/083; D06F 13/00; D06F 23/00; D06F 23/04; D06F 29/00

See application file for complete search history.

(56) References Cited

U.S. PATENT DOCUMENTS

| | | | |
|---|---|---|---|
| 1,795,395 | A | 3/1931 | Hoke |
| 2,019,089 | A | 10/1935 | Papworth |

(Continued)

FOREIGN PATENT DOCUMENTS

| | | |
|---|---|---|
| BR | DI7003246-7 | 10/2011 |
| BR | 102013015674 A2 | 7/2015 |

(Continued)

*Primary Examiner* — Joseph L. Perrin

(74) *Attorney, Agent, or Firm* — McGarry Bair PC

(57) ABSTRACT

A laundry treating appliance includes a first basket assembly including a first basket defining a first treating chamber for receiving laundry for treatment in a first wash environment. A balance ring forms an upper periphery of the first basket assembly and is operably coupled to the first basket. A second basket is selectively receivable within at least a portion of the first treating chamber. The second basket defines a second treating chamber for receiving laundry for treatment in a second wash environment.

20 Claims, 8 Drawing Sheets

Related U.S. Application Data continuation of application No. 15/651,631, filed on Jul. 17, 2017, now Pat. No. 10,533,273.

(51) Int. Cl.

| | |
|---|---|
| *D06F 13/00* | (2006.01) |
| *D06F 23/00* | (2006.01) |
| *D06F 39/00* | (2020.01) |

(56) References Cited

U.S. PATENT DOCUMENTS

| | | | |
|---|---|---|---|
| 2,218,275 | A | 10/1940 | Woodin |
| 2,748,788 | A | 6/1956 | Duckstein |
| 2,949,025 | A | 8/1960 | Tingley, Jr. |
| 3,014,358 | A | 12/1961 | Bochan |
| 3,026,699 | A | 3/1962 | Rhodes |
| 3,029,623 | A | 4/1962 | Morey |
| 3,145,551 | A | 8/1964 | Ziegler |
| 3,209,560 | A | 10/1965 | Shelton |
| 3,324,688 | A | 6/1967 | Hubbard |
| 3,481,162 | A | 12/1969 | Ziegler |
| 3,509,741 | A | 5/1970 | Morey |
| 3,575,020 | A | 4/1971 | Hubbard |
| 3,648,486 | A | 3/1972 | Rosinski, Jr. et al. |
| 3,987,652 | A | 10/1976 | Ruble |
| 4,118,957 | A | 10/1978 | Marcussen |
| 4,162,621 | A | 7/1979 | Stone |
| 4,175,409 | A | 11/1979 | Morey |
| 4,186,573 | A | 2/1980 | Brenner et al. |
| 4,207,760 | A | 6/1980 | Bochan |
| 4,225,992 | A | 10/1980 | Morey |
| 4,338,802 | A | 7/1982 | Ohmann et al. |
| 4,417,457 | A | 11/1983 | Brenner |
| 4,502,303 | A | 3/1985 | Wasemann |
| 4,637,230 | A | 1/1987 | Roberts |
| 4,637,231 | A | 1/1987 | McMillan et al. |
| 4,920,770 | A | 5/1990 | Dooley et al. |
| 5,113,542 | A | 5/1992 | Pastryk et al. |
| 5,440,903 | A | 8/1995 | Kropf et al. |
| 5,497,638 | A | 3/1996 | Berkcan et al. |
| 5,500,967 | A | 3/1996 | Wilson et al. |
| 5,611,221 | A | 3/1997 | Tremel |
| 5,651,277 | A | 7/1997 | Richardson |
| 5,689,847 | A | 11/1997 | Tremel et al. |
| 5,784,902 | A | 7/1998 | Pinkowski et al. |
| 5,855,127 | A | 1/1999 | Kohara et al. |
| 6,460,382 | B1 | 10/2002 | Kim et al. |
| 7,401,479 | B2 | 7/2008 | Fields |
| 7,866,191 | B2 | 1/2011 | Turner et al. |
| 9,091,013 | B2 | 7/2015 | Kim et al. |
| 9,404,213 | B2 | 8/2016 | Kappler |
| 9,863,078 | B2 | 1/2018 | Ramasco et al. |
| 2004/0116267 | A1 | 6/2004 | Mathieu et al. |
| 2005/0284197 | A1 | 12/2005 | Pinkowski et al. |
| 2007/0084254 | A1 | 4/2007 | Messina |
| 2007/0199664 | A1 | 8/2007 | Zacher et al. |
| 2008/0312773 | A1 | 12/2008 | Nag |
| 2009/0211108 | A1 | 8/2009 | Moschutz et al. |
| 2009/0293203 | A1 | 12/2009 | Hettinger et al. |
| 2010/0326141 | A1 | 12/2010 | Chung |
| 2011/0094902 | A1 | 4/2011 | Delehey et al. |
| 2013/0276483 | A1 | 10/2013 | Ryu et al. |
| 2013/0312462 | A1 | 11/2013 | Kim et al. |
| 2015/0059417 | A1 | 3/2015 | Ramasco |
| 2015/0184326 | A1 | 7/2015 | Seo et al. |
| 2015/0211163 | A1 | 7/2015 | Kim et al. |
| 2016/0201243 | A1 | 7/2016 | Bergamo |
| 2016/0222567 | A1 | 8/2016 | Ramasco et al. |
| 2016/0289884 | A1 | 10/2016 | Kim et al. |
| 2016/0296865 | A1 | 10/2016 | Blanks et al. |
| 2018/0237972 | A1 | 8/2018 | Lv et al. |
| 2018/0371668 | A1 | 12/2018 | Yonezawa et al. |
| 2019/0186064 | A1 | 6/2019 | Kim et al. |

FOREIGN PATENT DOCUMENTS

| | | | |
|---|---|---|---|
| BR | 102013018364 | A2 | 8/2015 |
| BR | 102013021866 | A2 | 8/2015 |
| BR | 102013015672 | A2 | 9/2015 |
| BR | 102013027400 | A2 | 9/2015 |
| BR | 102013025343 | A2 | 11/2015 |
| BR | 102014008903 | A2 | 12/2015 |
| BR | 102014010905 | A2 | 12/2015 |
| BR | 102014010908 | A2 | 12/2015 |
| BR | 102014018397 | A2 | 2/2016 |
| CN | 203530690 | U | 4/2014 |
| CN | 203729101 | U | 7/2014 |
| CN | 105220395 | A | 1/2016 |
| KR | 20030004708 | A | 1/2003 |
| KR | 20030045447 | A | 6/2003 |
| KR | 20150077264 | A | 7/2015 |
| WO | 2006087735 | A1 | 8/2006 |
| WO | 2013088426 | A2 | 6/2013 |
| WO | 2014201534 | A1 | 12/2014 |
| WO | 2015048870 | A1 | 4/2015 |
| WO | 2015058269 | A1 | 4/2015 |

LAUNDRY TREATING APPLIANCE WITH REMOVABLE BASKET

CROSS REFERENCE TO RELATED APPLICATIONS

This application is a continuation of U.S. application Ser. No. 16/713,041, filed Dec. 13, 2019, now U.S. Pat. No. 11,168,428, issued Nov. 9, 2021, which is a continuation of U.S. application Ser. No. 15/651,631, filed Jul. 17, 2017, now U.S. Pat. No. 10,533,273, issued Jan. 14, 2020, both of which are incorporated herein by reference in their entirety.

BACKGROUND

Laundry treating appliances, such as clothes washers, refreshers, and non-aqueous systems, may have a configuration based on a rotating basket that defines a treating chamber in which laundry items are placed for treating. The laundry treating appliance may have a controller that implements a number of pre-programmed cycles of operation having one or more operating parameters. The controller may control a motor to rotate the basket according to one of the pre-programmed cycles of operation. The controller may control the motor to rotate the basket at the same speeds for a give pre-programmed cycle of operation regardless of the characteristics of the laundry items or changes in the system.

BRIEF DESCRIPTION

In one aspect, the present disclosure relates to a laundry treating appliance comprising a first basket assembly including a first basket defining a first treating chamber for receiving laundry for treatment in a first wash environment and a balance ring forming an upper periphery of the first basket assembly and operably coupled to the first basket, wherein an extension protrudes radially from a portion of the balance ring and at least a portion of the first basket surrounds and forms a crimp about the extension to form a junction, and a second basket selectively receivable within at least a portion of the first treating chamber where the second basket defines a second treating chamber for receiving laundry for treatment in a second wash environment and wherein when the second basket is received within the at least a portion of the first treating chamber a portion of the second basket abuts the balance ring and an interface seal is provided at an interface defined where the second basket and the first basket assembly meet.

In another aspect, the present disclosure relates to a laundry treating appliance comprising a first basket assembly including a first basket defining a first treating chamber for receiving laundry for treatment in a first wash environment and a balance ring forming an upper periphery of the first basket assembly and operably coupled to the first basket, wherein an extension protrudes radially from a portion of the balance ring and at least a portion of the first basket surrounds and forms a crimp about the extension to form a junction, and a second basket selectively receivable within at least a portion of the first treating chamber where the second basket defines a second treating chamber for receiving laundry for treatment in a second wash environment and wherein when the second basket is received within the at least a portion of the first treating chamber a portion of the second basket abuts the balance ring and an interface is defined where the second basket and the first basket assembly meet.

DETAILED DESCRIPTION

Figure 1:
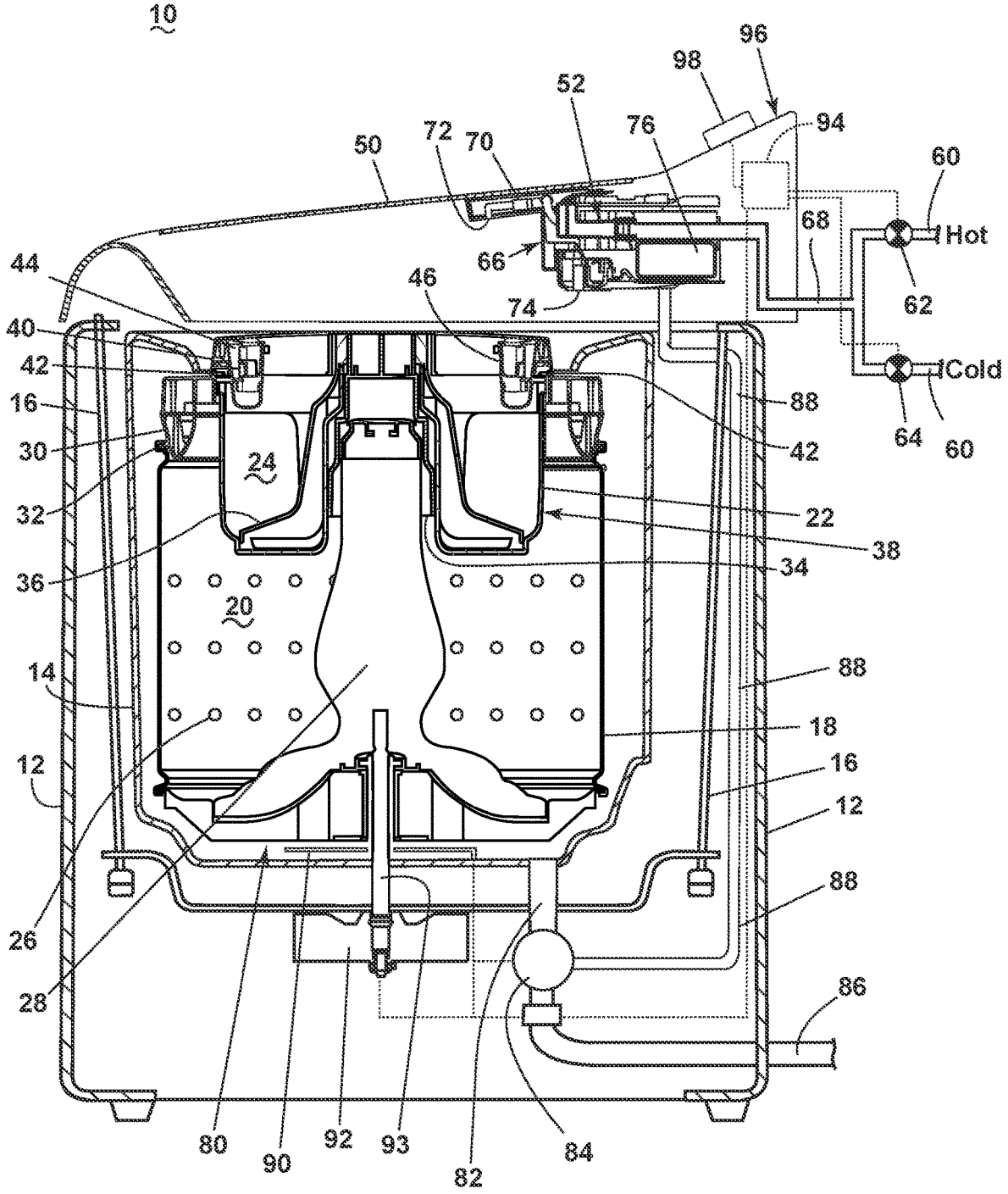
FIG. 1 is a schematic view of a laundry treating appliance in the form of a washing machine having a removable basket assembly and a lower basket with a first clothes mover.

Aspects of the disclosure relate to a laundry treating appliance including a dual-basket system including a lower basket and a removable basket assembly. A first treating chamber is formed by the lower basket and a second treating chamber is formed by an upper basket in the removable basket assembly. A cycle of operation can be used to treat laundry articles within one or more of the first or second treating chambers. The removable basket assembly seats at least partially within first treating chamber. A suitable sealing feature between the lower basket and the upper basket can fluidly separate the first treating chamber from the second treating chamber. The sealing feature can include a liquid-tight seal in order to prevent treating chemistries or wash liquids from entering into the other of the treating chambers. As such, fluidly sealing the first and second treating chambers can minimize cross-contamination among the separate treating chambers to provide effective treatment to the individual treating chambers, simultaneously. Many treating chemistries are deleterious to each other's functionality when mixed. Moreover, certain treating chemistries used in one treating chamber may be unsuitable for laundry loads being washed in the other of the treating chambers. Therefore, fluidly separating the first and second treating chambers can prevent deleterious effects among different or multiple treating chemistries and/or different loads being washed in respective treating chambers.

In the situation where the dual-basket system is utilizing the removable basket assembly, the removable basket assembly can be placed on a first clothes mover in the lower basket to mount the removable basket assembly within the laundry treating appliance. The upper basket can include a lip along a top, outer edge of the upper basket. The lower basket can include a balance ring at a top edge of the lower basket. The outer lip of the upper basket can rest on balance ring of the lower basket to form an interface seal. In one example, the interface seal can include a liquid-tight seal. The interface seal can be provided through an annular protrusion that extends out of the balance ring and a complementary annular flange that extends from the outer lip, which adjoin to form a liquid-tight seal between the first and second treating chambers at the junction between the lower and upper baskets. In one alternative example, a separate seal, such as a rubber ring, can be provided at the junction between the protrusion and the flange to further form a seal between the first and second baskets. In another alternative example, a deflector can extend from the balance ring adjacent to the lip in order to deflect water away from the lip.

Additionally, the weld or connection between the balance ring and the upper edge of the lower basket can become a leakage source, permitting a volume of liquid drained from the upper basket to pass into the lower basket. This interface can be alternatively be sealed with polymers, such as silicone or polymers in the form of a gasket. In another alternative example, a flange can be provided over the connection between the balance ring and the lower basket to deflect water to minimize or prevent water from leaking into the lower basket from the upper basket. Similarly, leakage may occur through perforations in a sidewall of the lower basket. In order to minimize or prevent such leakage, a curtain can extend from the balance ring along the sidewall of the lower basket to separate any liquid draining from the upper basket from the perforations in the lower basket.

Referring now to FIG. 1 a laundry treating appliance 10 can be any appliance which performs a cycle of operation to clean or otherwise treat items or articles placed therein, such as clothing laundry in one non-limiting example. The laundry treating appliance 10 is illustrated as a washing machine, which can include a structural support system comprising a cabinet 12 which defines a housing within which a laundry holding system resides. The cabinet 12 can be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the present disclosure.

The laundry treating appliance 10 includes a tub 14 supported within the cabinet 12 by a suitable suspension system 16 for dynamically suspending portions of the laundry treating appliance 10 within the cabinet 12. A first basket 18 is provided within the tub 14 and defines a first treating chamber 20 forming a first wash environment. The first basket 18 can include a plurality of perforations 26 such that liquid can flow between the tub 14 and the first basket 18 through the perforations 26. In some applications, it is possible that the first basket 18 is imperforate. A first clothes mover 28 is provided the first treating chamber 20 to move or agitate laundry articles received in the first treating chamber 20 according to a cycle of operation. Clothes mover as used herein can mean any suitable clothes mover to impart mechanical energy to a load of laundry, such as an agitator, mover, blade, impeller, or auger in non-limiting examples. A balance ring 30 can be provided along an upper edge 32 of the first basket 18.

A removable basket assembly 38 can include a second basket 22 that is at least partially provided within the first basket 18 and defines a second treating chamber 24 forming a second wash environment. A transmitter 34 can be included in the removable basket assembly 38 and can removably attach to the first clothes mover 28. The transmitter 34 facilitates attachment and removal of the removable basket assembly 38 to and from the first clothes mover 28 to position the second basket 22 at least partially within the first treating chamber 20. A second clothes mover 36 is provided within the second basket 22 and is coupled with the first clothes mover 28 via the transmitter 34.

An upper ring 40 can be included in the removable basket assembly 38 and can operably couple to the second basket 22. The upper ring 40 can include an outer diameter that is greater than a diameter of the second basket 22. The upper ring 40 can extend at least partially over and seat upon the balance ring 30, such that the balance ring 30 can at least partially support the removable basket assembly 38 at the upper ring 40. A set of outlets 42 can be provided in the upper ring 40 to provide egress for liquid from the second basket 22. A set as used herein can include any number of elements, including only one. A detergent dispenser 44 and a fabric softener dispenser 46 can mount along the interior of the upper ring 40 and extend into the second treating chamber 24. Furthermore, the upper ring 40 can partially form the dispensers 44, 46. While the dispensers 44, 46 are described as specific to detergent and fabric softener, the dispensers 44, 46 can be used for dispensing any suitable treating chemistry into the second basket 22, which can be particular to a cycle of operation, including but not limited to water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. In one non-limiting example, the detergent dispenser 44 can be a dispenser as disclosed in U.S. Pub. No. 2015/0059417 to Ramasco, filed Aug. 27, 2014, entitled "Valved Dispensing System for Products in Liquid Form by Inertial Centrifugal Action for Household Appliances," which is herein incorporated by reference in full.

The removable basket assembly 38 can further include coupling elements disposed on the periphery of the second basket 22. Such coupling elements can couple the removable basket assembly 38 to the first basket 18 and permit common rotation among the two. In one non-limiting example, the coupling elements can be similar to those as disclosed in U.S. Pub. No. 2016/0222567 to Ramasco et al., filed Oct. 23, 2015, now U.S. Pat. No. 9,863,078, issued Jan. 9, 2018, entitled "Coupling System of Removable Compartment for Appliances," which is herein incorporated by reference in full, and the removable basket assembly 38 can couple in the same manner as described therein.

It should be appreciated that the removable basket assembly 38 is removable, such that the laundry treating appliance 10 can be used with or without the removable basket assembly 38. The balance ring 30 on the first basket 18 and the transmitter 34 coupled to the first clothes mover 28 are used to support the removable basket assembly 38.

The laundry treating appliance 10 can further include a door 50 which can be movably mounted to the cabinet 12 to selectively close access to the first basket 18, or the second basket 22. The laundry treating appliance 10 can further include a liquid supply system 52 for supplying water to the laundry treating appliance 10 for use in treating laundry during a cycle of operation. The liquid supply system 52 can include a source of water, such as a household water supply 60, which can include separate valves 62 and 64 for controlling the flow of hot and cold water, respectively. Water can be supplied to a liquid manifold 66 via a supply conduit 68. Optionally, one or more additional valves can be included on the supply conduit 68 to selectively provide water to the liquid manifold 66, or to tailor water temperature from the household water supply 60. A water dispenser 70, fluidly coupled to the liquid manifold 66, can mount to the door 50, for providing water to one or more of the first and second baskets 18, 22 via a first outlet 72. The water dispenser 70 can overhang above the first and second baskets 18, 22 such that water dispensed from the first outlet 72 can pass into the second basket 22 when using the removable basket assembly 38, or into the first basket 18 when the removable basket assembly 38 is not being used. A second outlet 74 can be provided on the liquid manifold 66 dedicated to the first basket 18. The second outlet 74 can be positioned outside of the second basket 22, such that any dispensed water will pass into the space between the tub 14 and the upper ring 40, passing into the first treating chamber 20, but not into the second treating chamber 24. The water dispenser 70 can be dedicated to the removable basket assembly and the second outlet 74 can be dedicated to the first basket 18; however, the laundry treating appliance 10 should not be so limited.

A dispenser 76 can be provided within or adjacent to the liquid manifold 66 and in fluid communication with the liquid manifold 66. The dispenser 76 can be used to dispense treating chemistry to the first basket 18 through the second outlet 74. Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry treating appliance 10 can also include a recirculation and drain system for recirculating or draining liquid within the laundry treating appliance 10. Liquid supplied to the tub 14 typically enters a space between the tub 14 and the first basket 18 and can flow by gravity to a sump 80 formed in part by a lower portion of the tub 14. The sump 80 can also be formed by a sump conduit 82 that can fluidly couple the lower portion of the tub 14 to a pump 84. The pump 84 can direct liquid to a drain conduit 86, which can drain the liquid from the laundry treating appliance 10, or to a recirculation conduit 88, which can direct the liquid from the sump conduit 82 into the liquid manifold 66, which can be returned to one or more of the first or second treating chambers 20, 24. In this manner, liquid provided to the tub 14, with or without treating chemistry can be recirculated into either the first or second treating chambers 20, 24 for treating the laundry per one or more cycles of operation.

The liquid supply and/or recirculation and drain system can be provided with a heating system which can include one or more devices for heating laundry and/or liquid supplied to the tub 14, such as a sump heater 90, which can be used to heat the laundry and/or liquid within the tub 14 as part of a cycle of operation.

Additionally, the liquid supply, recirculation and drain system can differ from the configuration shown in FIG. 1, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry.

The laundry treating appliance 10 also includes a drive system for rotating the first and second baskets 18, 22 within the tub 14. The drive system can include a motor 92, which can be directly coupled with the first basket 18 and the first clothes mover 28 through a drive shaft 93 to rotate or reciprocate the first basket 18 or the first clothes mover 28 about a rotational axis during a cycle of operation. Additionally, the rotational movement of the first clothes mover 28 can be imparted to the second clothes mover 36 and rotational movement of the first basket 18 can be imparted to the second basket 22. The motor 92, in one non-limiting example, can be a brushless permanent magnet (BPM) motor. Other motors, such as an induction motor or a permanent split capacitor (PSC) motor, can also be used. The motor 92 can rotate the first basket 18 and the second basket 22 at various speeds in either rotational direction, and can reciprocate the first and second clothes movers 28, 36 within its respective basket.

The laundry treating appliance 10 also includes a control system for controlling the operation of the laundry treating appliance 10 to implement one or more cycles of operation. The control system can include a controller 94 located within the cabinet 12 and a user interface 96 that is operably coupled with the controller 94. The controller 94 operably couples to the liquid supply system 52 and the user interface 96. The user interface 96 is configured to receive input from a user and provide output to the user. Such input can be used to select a cycle of operation, for example, and output can include information related to the cycle of operation, such as status. The input can be communicated to the controller 94, indicative of and including instructions to execute the cycle of operation. The user interface 96 can include one or more knobs 98, dials, switches, displays, touch screens and the like for communicating with the user, such as to receive input and provide output. The user can enter different types of information including, without limitation, cycle selection and cycle parameters, such as cycle options.

The controller 94 can include the machine controller and any additional controllers provided for controlling any of the components of the laundry treating appliance 10. For example, the controller 94 can include the machine controller and a motor controller. It is contemplated that the controller 94 is a microprocessor-based controller that implements control software and sends/receives one or more electrical signals to/from each of the various working components to effect the control software.

Figure 2:
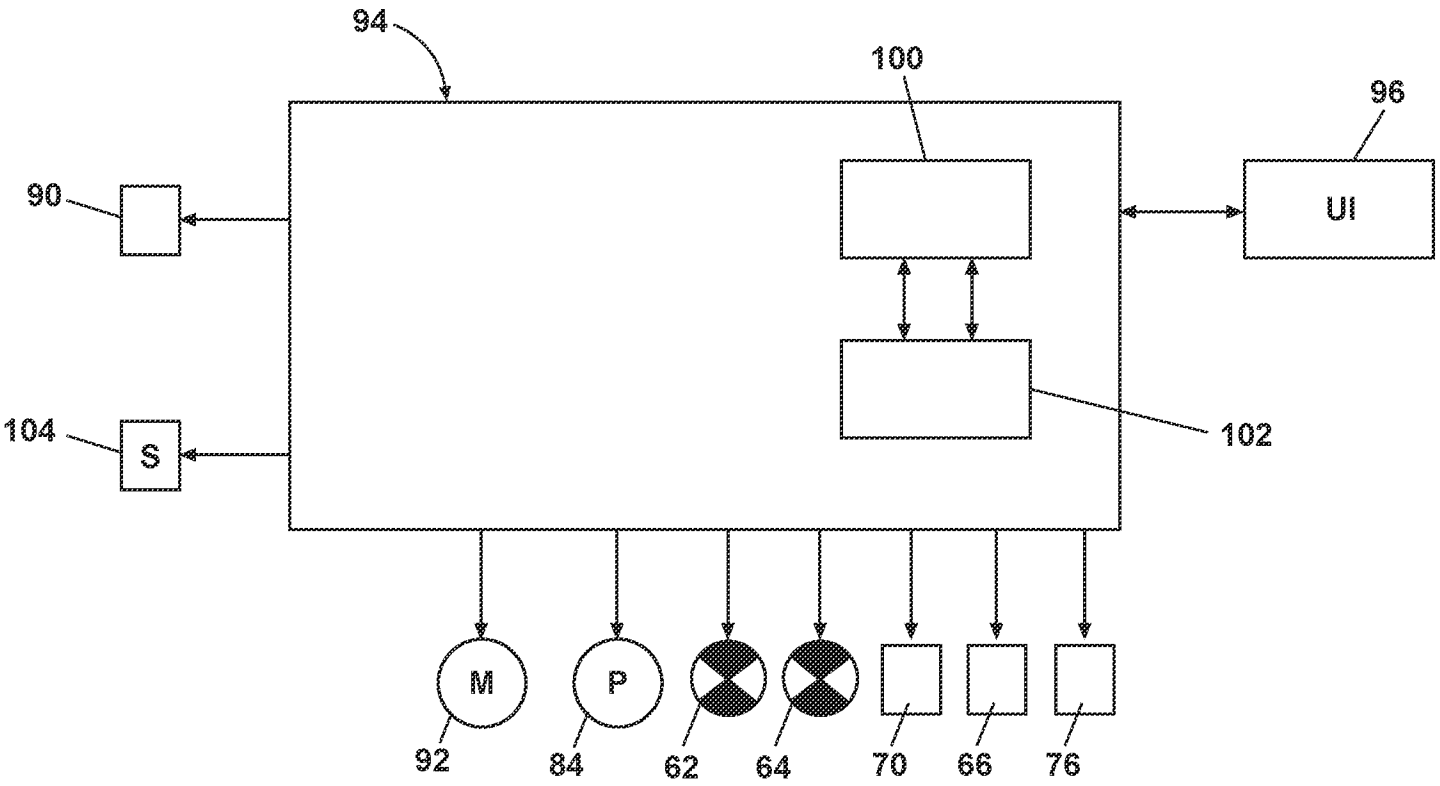
FIG. 2 is a schematic of a control system of the laundry treating appliance of FIG. 1.

Referring to FIG. 2, the controller 94 can be provided with a memory 100 and a central processing unit (CPU) 102. The memory 100 can be used for storing the control software that is executed by the CPU 102 in completing a cycle of operation using the laundry treating appliance 10 and any additional software. Examples, without limitation, of cycles of operation include: wash, heavy duty wash, delicate wash, quick wash, pre-wash, refresh, rinse only, and timed wash.

The controller 94 can be operably coupled with one or more components of the laundry treating appliance 10 for communicating with and controlling the operation of the component to complete a cycle of operation. For example, the controller 94 can be operably coupled with the motor 92, the pump 84, the liquid manifold 66, the water dispenser 70, the dispenser 76, the sump heater 90 which can be provided throughout the laundry treating appliance 10 to implement the operation of these and other components to implement one or more of the cycles of operation. Additional instruction or communication can be sent to or received from a user through the user interface 96.

The controller 94 can also be coupled with one or more sensors 104 provided in one or more of the systems of the laundry treating appliance 10 to receive input from the sensors, which are known in the art and not shown for simplicity. Non-limiting examples of sensors 104 that can be communicably coupled with the controller 94 include: a treating chamber temperature sensor, a moisture sensor, a weight sensor, a chemical sensor, a position sensor and a motor torque sensor, which can be used to determine a variety of system and laundry characteristics, such as laundry load inertia or mass. One particular sensor can be a position sensor to determine whether the removable basket assembly 38 is positioned within the laundry treating appliance 10. Another particular sensor can be a flow meter, which can be used to measure and control the amount of water filling the removable basket assembly 38. The flow meter could minimize or prevent the occurrence of water leaving the removable basket assembly 38 during the filling phase, and minimize contamination potential with the first basket 18. Yet another particular sensor can include a sensor for determining the presence of the removable basket assembly 38. Additionally, detection of the removable basket assembly 38 can be detected in a manner disclosed in U.S. Pat. Pub. No. 2016/0201243 to Bergamo, filed Oct. 23, 2015, now U.S. Pat. No. 9,777,419, issued Oct. 3, 2017, entitled "Detection System of Washing Machines Removable Basket and Method for Detection of Washing Machines Removable Basket," which is herein incorporated by reference in full.

The laundry treating appliance 10 can be operated with both the first basket 18 and the second basket 22, simultaneously, or can be operated with either the first basket 18 or the second basket 22 individually. When executing a cycle of operation within the first basket 18 without the removable basket assembly 38, the second basket 22, including the transmitter 34, can be removed from the laundry treating appliance 10. When using the removable basket assembly 38 alone, laundry articles need to be provided only in the second basket 22. In such an organization, the removable basket assembly 38 mounts on the first clothes mover 28. Rotational or reciprocating movement of the first clothes mover 28 is transferred to the second clothes mover 36 via the transmitter 34. When using both the first and second baskets 18, 22, the first basket 18 can be filled with laundry articles, then the removable basket assembly 38 installs over the first treating chamber 20, and the second basket 22 is filled with additional laundry articles. The reverse of the aforementioned process can be used to remove laundry articles after a cycle of operation has completed.

In operation using both the removable basket assembly 38 and the first basket 18, treating chemistry can be provided in one or more of the dispensers 44, 46, 76, to treat the laundry articles according to a desired cycle of operation. A user can select a cycle of operation on the user interface 96, such as a standard wash cycle of operation. Different cycles of operation can be tailored to different or individual treating chambers, as well as different organizations, such as with or without the removable basket assembly 38. Water can fill the first basket 18 dispensed from the second outlet 74 and passing to fill the tub 14, and then filling the first basket 18 through the perforations 26. Water can simultaneously fill the second basket 22 dispensed from the first outlet 72 of the water dispenser 70. Detergent can be dispensed into the first treating chamber 20 from the dispenser 76 in the liquid manifold 66 and can be dispensed into the second treating chamber 24 from the dispensers 44, 46 on the upper ring 40. The first and second clothes movers 28, 36 can agitate the articles within the first and second treating chambers 20, 24, respectively. Rotational or reciprocating movement of the first clothes mover 28 is translated to the second clothes mover 36 via the transmitter 34. After completion of the wash cycle, the liquid can drain from the first treating chamber 20 into the tub 14. The motor 92 can then rotate the first basket 18 and impart rotational movement to the second basket 22. The rotational movement of the second basket 22 can drive liquid within the second basket 22 outward and upward toward the outlets 42, where water can drain over the balance ring 30 and into the tub 14 exterior of the first basket 18. The liquid can drain from the laundry treating appliance 10 through the drain conduit 86. A rinse cycle can then begin, refilling both the first and second treating chambers 20, 24 in the same manner as the wash cycle. The water can be again drained and a spin cycle can begin. Rotational movement is transferred from the motor to the second basket 22 via the first basket 18. Liquid can drain from the first and second treating chamber 20, 24 in the same manner as draining the wash cycle. As such, the first and second treating chambers 20, 24 can treat two individual loads of articles separately, but simultaneously.

Alternatively, the second basket 22 can be used alone. The operation can be similar to that described above, without filling, draining, or treating any articles within the first treating chamber 20. Rotational or reciprocating movement is still imparted to the first basket 18 and the first clothes mover 28, which is transferred to the second basket 22 and the second clothes mover 36, respectively, in order to treat articles in the second basket 22.

Alternatively, the first basket 18 can be used alone. The removable basket assembly 38 can be removed and the first basket 18 can treat a load of laundry in a manner similar to that of a traditional laundry treating appliance 10. In yet another alternative, the removable basket assembly 38 can remain on top of the first basket 18, and the first treating chamber 20 can be used to treat a load of laundry articles while carrying the removable basket assembly in a manner described above, without the steps involved with treating articles within the second basket 22.

Figure 3:
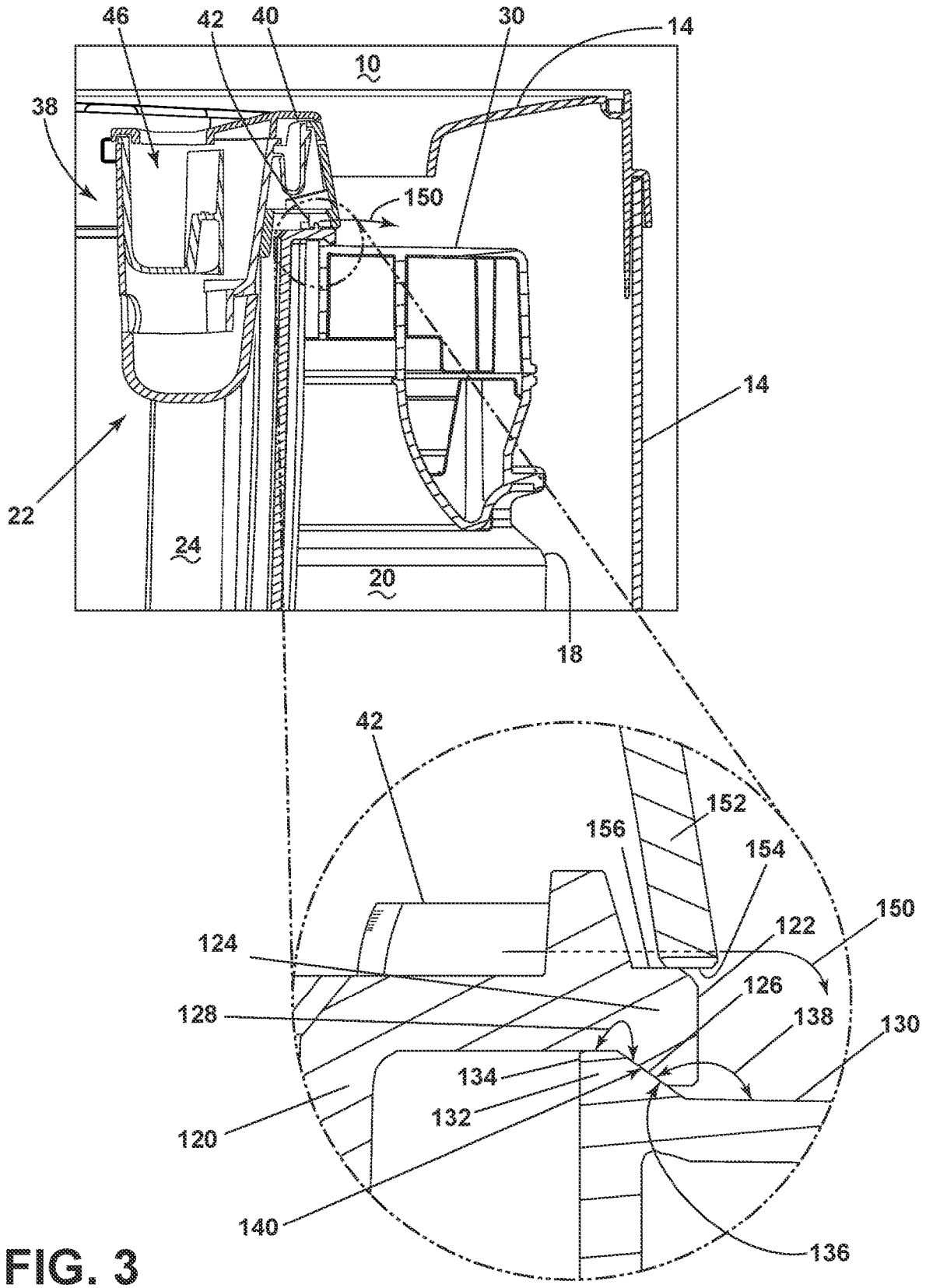
FIG. 3 is an enlarged cross-sectional view of FIG. 1 showing a seal formed between the removable basket assembly and a balance ring of the lower basket.

Referring now to FIG. 3, a rim 120 can define an edge at an upper periphery of the second basket 22, having an outer edge 122. A lip 124 including a first sloping surface 126 can extend around the second basket 22 from the rim 120. The first sloping surface 126 can be provided at a first angle 128 relative to the rim 120. The first angle 128 can be greater than 90-degrees, for example.

A top wall 130 can define the upper periphery for the balance ring 30. The rim 120 can rest upon the balance ring 30, permitting the first basket 18 to support the second basket 22 at the balance ring 30. An annular protrusion 132 formed as part of the balance ring 30 extends adjacent a radially inner edge 134 of the top wall 130. The annular protrusion 132 can include a second sloped surface 136. The second sloping surface 136 can be provided at a second angle 138, relative to the top wall 130.

The first sloping surface 126 can be complementary to the second sloping surface 136, such that alignment of the first and second sloping surfaces 126, 136 forms a liquid-tight seal. Optionally, the first angle 128 can be supplementary to the second angle 138, such that the first and second angles 128, 138 add up to 180-degrees. The sloping surfaces need not be linear surfaces, but rather can be complementary profiles or surfaces adapted to fit together or interface to form the liquid-tight seal.

The upper ring 40 can include an outer wall 152 having a bottom surface 154. A top surface 156 of the rim 120 can abut the bottom surface 154 of the upper ring 40 when the upper ring 40 mounts to the second basket 22 in forming the removable basket assembly 38.

During installation of the removable basket assembly 38, the second basket 22 can rest on the balance ring 30. A sealing interface can be defined where the second basket 22 meets the first basket 18, or the balance ring 30 on the first basket 18, to form an interface seal 140. The interface seal 140 can impede contamination between the first and second wash environments in the first and second treating chambers 20, 24. The interface seal 140 can impede contamination between the first and second wash environments to an appropriate extent such that overall efficacy of the two wash environments is not compromised for treating purposes. This is particularly advantageous when different wash environments are suitable for the respective loads being treated in each of the baskets. The interface seal 140 could be liquid-tight. In other examples, however, the interface seal 140 could allow some liquid flow, whether due to manufacturing tolerances or for other reasons. Regardless, the interface seal 140 impedes contamination between the wash environments to enable the laundry treating appliance 10 to maintain separate wash environments suitable for each load.

Additionally, at installation, the rim 120 sits on the balance ring 30 and seats the lip 124 at the protrusion 132, with the first sloping surface 126 abutting the second sloping surface 136 to form a the interface seal 140. Additionally, the sloped orientation for the first and second sloping surfaces 126, 136 provide for directing water away from the first basket 18 at the interior of the balance ring 30, which further improves the seal from permitting liquid to pass into the first basket 18. The first and second sloping surfaces 126, 136 can form complimentary sloping surfaces, each having a sloped profiled oriented complementary to one another.

The lip 124 and the protrusion 132 provide for improved liquid sealing at the junction between balance ring 30 of the first basket 18 and the second basket 22, impeding contamination between the first and second wash environments. Liquid 150 can drain from the second basket 22 through the outlet 42 to the balance ring 30. The improved sealing can minimize cross-contamination among the first and second treating chambers 20, 24, for liquid 150 drained through the outlets 42, which can provide for improved treatment of laundry articles within the laundry treating appliance, particularly when being treated according to separate cycles of operation.

Additionally, another seal 156 can be at the confronting bottom surface 154 of the upper ring 40 and the top surface 156 of the rim 120. This seal 156 need not have sloped surfaces, similar to the of the lip 124 abutting the protrusion 132, but can minimize leakage or prevent water from leaking from the outlet 42 in the upper ring 40 to the balance ring 30, or water leaking into the upper ring 40 that can pass into the second treating chamber 24.

While described as sealing the laundry treating appliance 10 between the second basket 22 and the balance ring 30, it is alternatively contemplated that the first basket 18 does not include a balance ring, but that the first basket 18 can terminate at an upper edge with sealing features similar to those described for the balance ring, such as a protrusion in order to facilitate a water-tight seal between the first basket 18 and the second basket 22.

Figure 4:
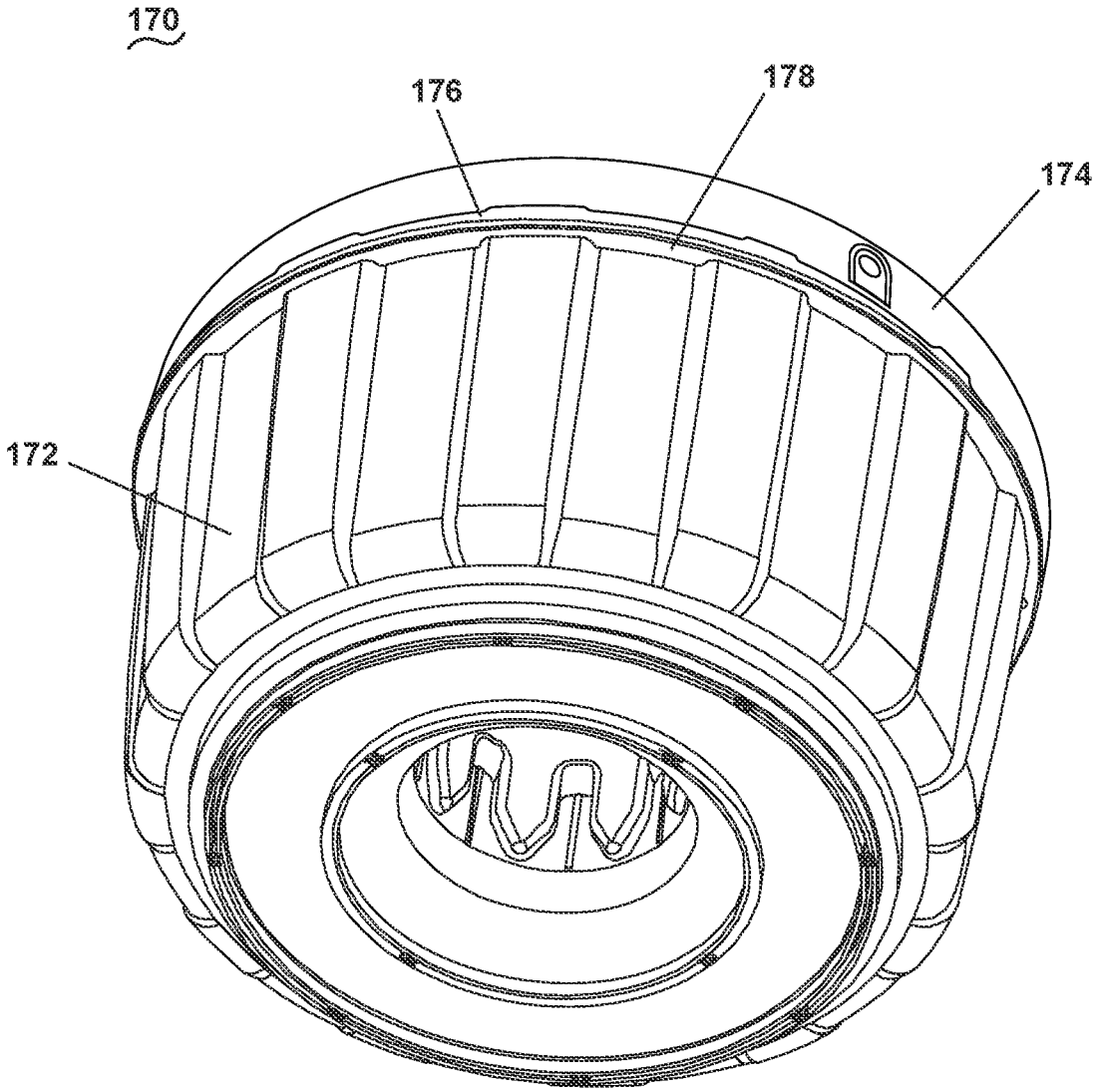
FIG. 4 is a bottom perspective view of an alternative basket for the laundry treating appliance of FIG. 1 including a seal.

Referring now to FIG. 4, an alternative removable basket assembly 170 can include a second basket 172 mountable within a laundry treating appliance, and can be similar to the second basket 22 of FIGS. 1 and 3. An upper portion 174 can mount on the second basket 172. A rim 176 can extend radially outwardly from the second basket 172. The upper portion 174 can mount to the second basket 172 at the rim 176. A seal 178 can couple to the second basket 172 at the rim 176, opposite of the upper portion 174. The seal 178 can attach to the second basket 172 through interference assembly, by using fasteners, or being co-injected or over injected in the second basket 172, in non-limiting examples. The seal 178 can be adapted to seat between the second basket 172 and a balance ring or a first basket of the laundry treating appliance, such as that of FIG. 1. In non-limiting examples, the seal 178 can be made of a flexible material or a compressible material, such as rubber or malleable plastic. As installed, the weight of laundry articles or liquid within the second basket 172 can form a liquid-tight seal the seal 178. A flexible material for the seal 178 can provide for an improved seal at the junction between the second basket 172 and a balance ring or first basket.

Figure 5:
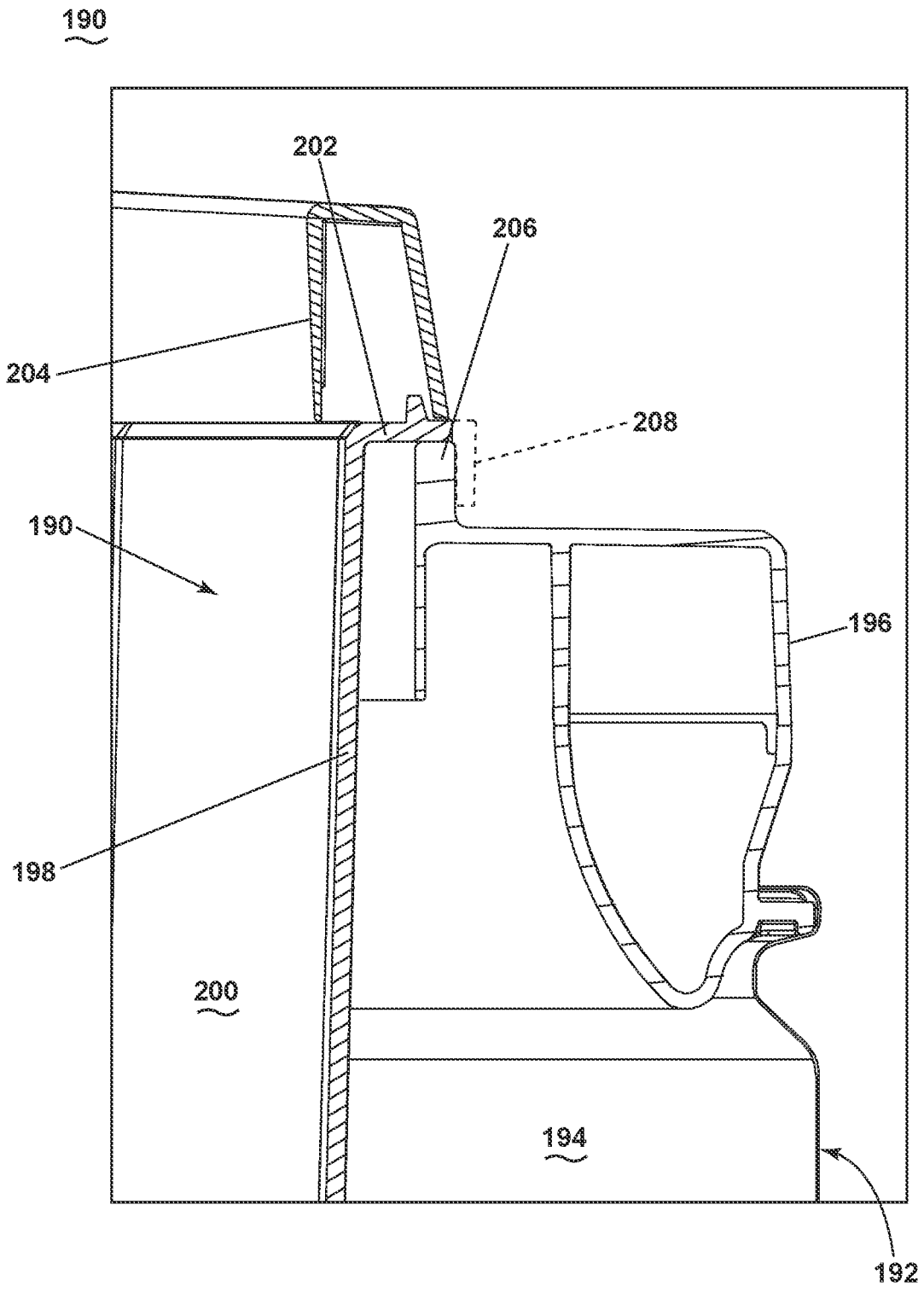
FIG. 5 is a cross-sectional view of another seal for a removable basket assembly in the form of a rib extending from a balance ring.

Referring now to FIG. 5, another section of an exemplary removable basket assembly 190 mounts on a first basket 192 defining a first treating chamber 194 and having a balance ring 196. A second basket 198, defining a second treating chamber 200 can be included in the removable basket assembly 190. A rim 202 can extend from the second basket 198 and can seat on the balance ring 196. An upper ring 204 can be included in the removable basket assembly 190 and can mount on the rim 202. A rib 206 can extend from the balance ring 196 opposite of the first basket 192. The rib 206 can be positioned to seat the rim 202 of the second basket 198. The rib 206 can have a height sufficient to prevent any liquid along the balance ring 196 to pass into the first treating chamber 194 at the second basket 198. Optionally, the second basket 198 can include flange 208 that extends from the rim 202 to overhang the rib 206.

The rib 206 can block liquid moving along the balance ring 196 toward the junction between the first basket 192 and the second basket 198, which can provide for minimizing or preventing liquid contamination between the first basket 192 and the second basket 198. During filling of the first basket 192, some of the liquid may pass along the balance ring 196. The rib 206 can block any water along the balance ring 196 from passing toward the second basket 198. Optionally, the flange can extend along and overhang over the rib 206 to further form a liquid-tight seal, and can provide for guiding the removable basket assembly 190 during installation on the first basket 192, as well as stabilizing the removable basket assembly 190.

Figure 6:
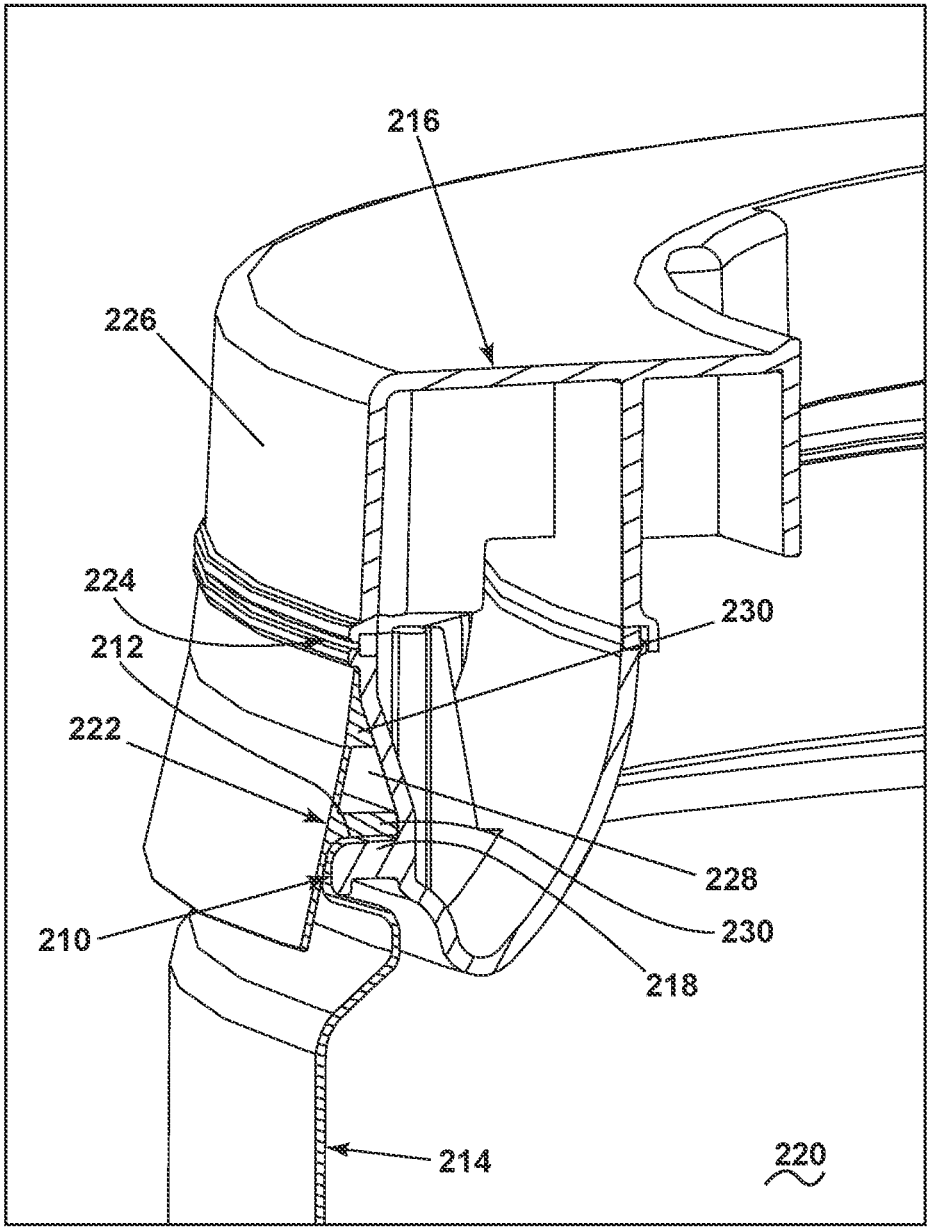
FIG. 6 is a cross-sectional view of a deflector on a balance ring to deflect a volume of liquid away from a crimp between the balance ring and a first basket.

Referring now to FIG. 6, a first basket 214 can define a first treating chamber 220. A balance ring 216 can be provided on the first basket 214 at an upper edge 212 of the first basket 214. The balance ring 216 can be separated into a first part 226 and a second part 228 adjoined at a junction 224. A crimp 210 can be formed at a junction between an upper edge 212 of a lower basket 214 and a balance ring 216 to mount the balance ring 216 on the lower basket 214. Alternatively, it is contemplated that the junction can be formed by fastening the balance ring 216 to the first basket 214 with fasteners, such as screws, or any other suitable fastening method. A flange 218 can extend from the balance ring 216 and the crimp 210 can be shaped around a flange 218. The crimp 210 can be a source of leakage into the first treating chamber 220 for liquid travelling over the top of the balance ring 216. This leakage can be a source of external contamination of the first treating chamber 220.

A deflector 222 can mount to the balance ring 216 and overhang the crimp 210. The deflector 222 can mount at the junction 224 and extend downward beyond the crimp 210. Optionally, it is contemplated the deflector 222 can mount above, at, or below the junction 224, or anywhere along the balance ring 216. A set of fingers 230 can extend from the deflector 222 abutting the balance ring 216 and the crimp 210 to fix the deflector 222 at an angle extending away from the balance ring 216. Alternatively, it is contemplated that the deflector 222 can be shorter and provided at a steeper angle, such that it does not extend over the crimp. Such and organization can provide or deflecting liquid over and past the crimp 210, while minimizing materials to decrease manufacturing costs for the deflector 222.

The deflector 222 can direct liquid falling along the balance ring 216 radially away from the crimp 210, relative to an axis of rotation of the first basket 214. Deflection of liquid by the deflector 222 can minimize or prevent liquid from entering the first treating chamber 220 at the crimp 210. The deflector 222 can be utilized with the balance rings of FIGS. 3-5 to further improve liquid sealing between a first treating chamber and a removable basket assembly. Alternatively, the deflector 222 can be utilized alone, with any basket including a balance ring to minimize leakage at a crimp adjoining the balance ring to the basket.

Figure 7:
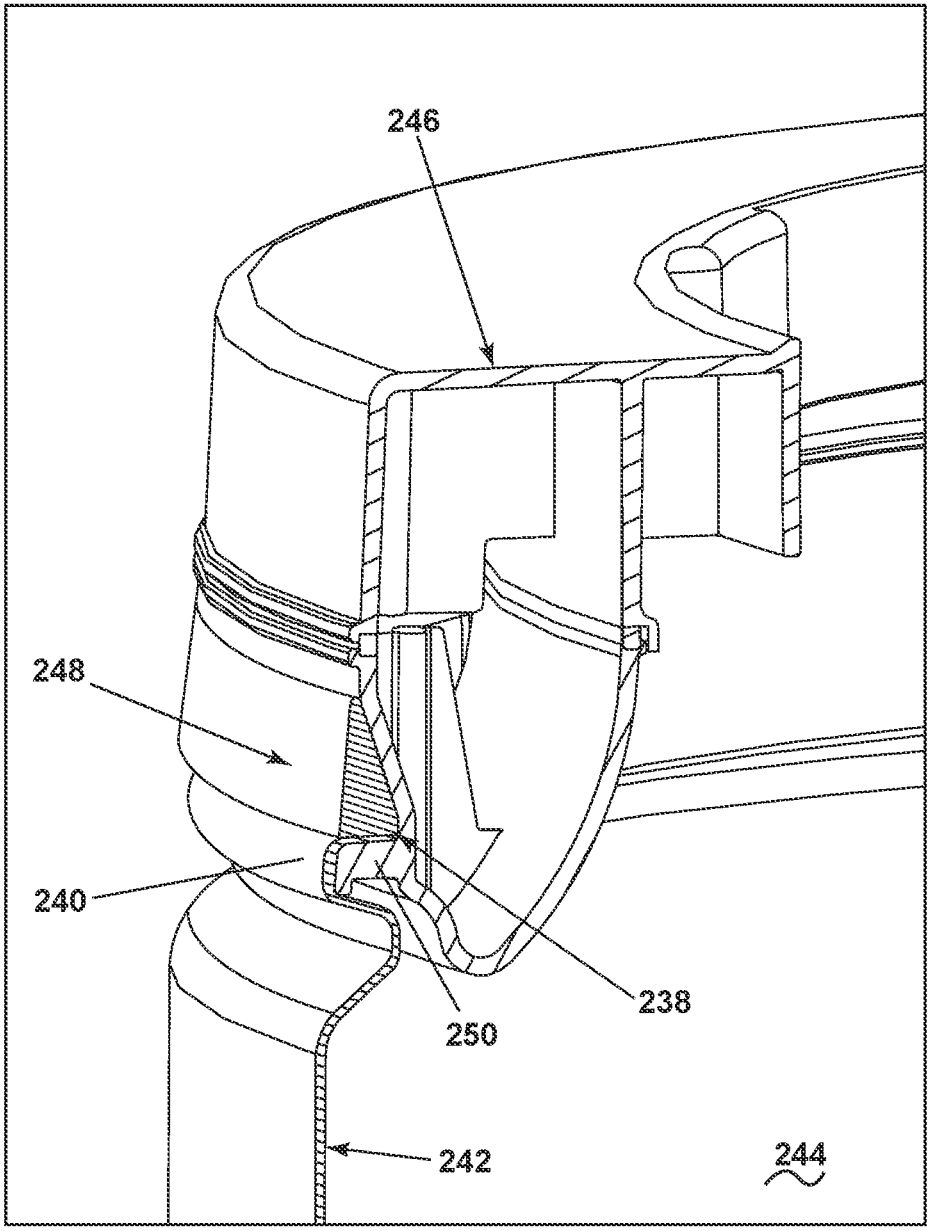
FIG. 7 is a cross-sectional view of a gasket provided at a junction between a balance ring and a first basket to prevent leaking at the junction.

Referring now to FIG. 7, alternative to the deflector of FIG. 6, a junction 238 shown as a crimp 240 can be formed between a first basket 242 defining a first treating chamber 244 and a balance ring 246. An extension 250 from the balance ring 246 can be surrounded by a portion of the first basket 242 to form the crimp 240. A gasket 248 can be provided at the crimp 240. The gasket 248 can provide for sealing the first treating chamber 244 from potential leakage at the crimp 240. The gasket 248 can be formed by hot-melt silicone extending circumferentially around the crimp 240. Alternatively, any suitable polymer, resin, or any other suitable material can be used to form the gasket 248. In yet another example, the crimp 240 can be welded to seal the first basket 242 to the balance ring 246. The polymer, resin, gasket, or weld, however, can increase costs associated with manufacturing the laundry treating appliance. In yet another example, the gasket 248 can be provided interior of the crimp 240, between the first basket 242 and the balance ring 246.

Figure 8:
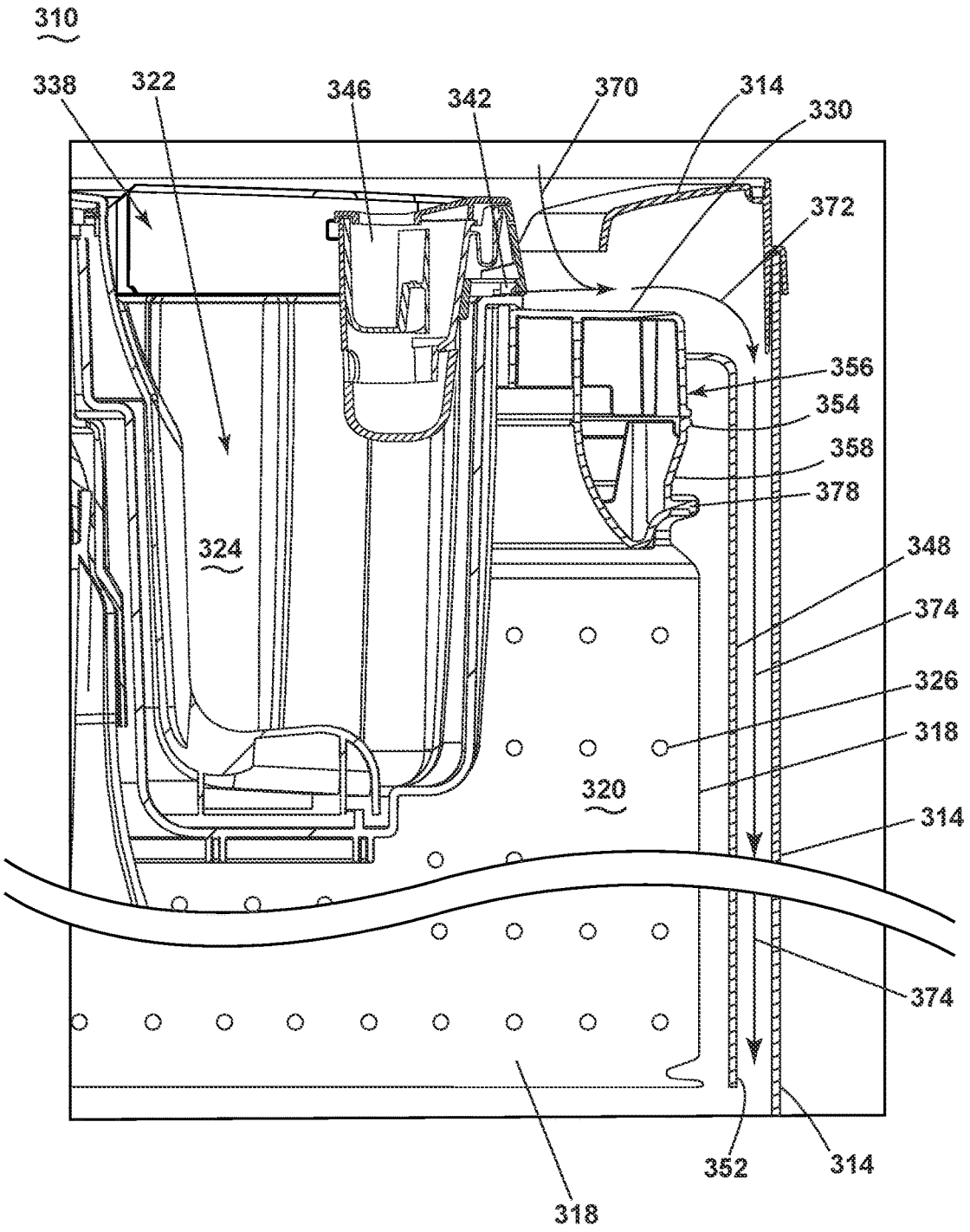
FIG. 8 is a cross-sectional view of a curtain extending from a balance ring attachment to deflect a volume of liquid away from perforations in a lower basket.

Referring now to FIG. 8, a laundry treating appliance 310 can be substantially similar to that of FIG. 1. As such, similar numerals will be used to identify similar elements increased by a value of three hundred, and the discussion will be limited to differences between the two. A first basket 318 defining a first treating chamber 320 includes perforations 326 and a balance ring 330. The first basket 318 can be mounted within a tub 314. A removable basket assembly 338, having a second basket 322 defining a second treating chamber 324 can mount at least partially within the first basket 318. A curtain 348 can mount to the balance ring 330 and extend at least partially along the first basket 318 between the first basket 318 and the tub 314, terminating at a bottom end 352. The curtain 348 can remain spaced from the first basket 318, to permit water to drain through the perforations 326 at the curtain 348. The length of the curtain 348 can be similar to that of the height of the first basket 318, having the bottom end 352 positioned near a bottom of the first basket 318. Alternatively, the curtain 348 can extend only mid-way or partially down the first basket 318.

The curtain 348 can mount at any position along the balance ring 330, as well as along the first basket 318. Preferably, the curtain 348 can mount at or above a junction 354 between a first portion 356 and a second portion 358 of the balance ring 330, and above a crimp 378 coupling the first basket 318 and the balance ring 330. The curtain 348 can be made of a flexible material, such as a plastic, rubber, or polymer in non-limiting examples. Additionally, the curtain 348 can be made of a low-friction material in order to minimize the instance of sticking between the curtain 348 and the first basket 318. Further still, the curtain 348 can be made of a bacterial or microbial resistant material.

In operation, a volume of liquid can drain from the outlet 342 in the second basket 322, or be provided to the first basket 318 between the tub 314 and the removable basket assembly 338 in a space between the first basket 318 and the tub 314, passing over the balance ring 330, shown at arrow 370. The liquid can pass over the balance ring 330 and fall to the curtain 348, at 372, to drain toward the tub 314 at 374. The curtain 348 prevents draining liquid from entering the first basket 318 through the perforations 326, which liquid can contaminate laundry articles within the first basket 318. During a spin cycle, liquid can pass through the perforations 326 of the first basket 318 and contact the curtain 348, and is permitted to drain to the tub 314. The curtain 348 can minimize contamination or mixing of separate liquids or treating chemistries between the first basket 318 and the second basket 322 of the removable basket assembly 338, which may otherwise mix through the perforations 326 or leak through the balance ring 330 or at the crimp 378.

The sealing features as described herein provide a liquid-tight seal, minimizing or preventing mixing or cross-contamination of separate liquids within a dual-basket washing machine, such as that of FIG. 1. Preventing mixing or cross-contamination can provide for improved and accurate treatment among separate loads in the separate baskets. Additionally, such separation can provide for improved functionality of cycles of operation which can be tailored to specific treating chambers operating separately and simultaneously within the same laundry treating appliance.

To the extent not already described, the different features and structures of the various aspects may be used in combination with each other as desired. That one feature may not be illustrated in all of the aspects is not meant to be construed that it cannot be, but is done for brevity of description. Thus, the various features of the different aspects may be mixed and matched as desired to form new aspects, whether or not the new aspects are expressly described.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure, which is defined in the appended claims.

What is claimed is:

1. A laundry treating appliance comprising:

a first basket assembly including a first basket defining a first treating chamber for receiving laundry for treatment in a first wash environment and a balance ring forming an upper periphery of the first basket assembly and operably coupled to the first basket, wherein an extension protrudes radially from a portion of the balance ring and at least a portion of the first basket surrounds and forms a crimp about the extension to form a junction; and a second basket selectively receivable within at least a portion of the first treating chamber where the second basket defines a second treating chamber for receiving laundry for treatment in a second wash environment and wherein when the second basket is received within the at least a portion of the first treating chamber a portion of the second basket abuts the balance ring and an interface seal is provided at a sealing interface defined where the second basket and the first basket assembly meet.

2. The laundry treating appliance of claim 1 wherein the balance ring or the second basket include a compressible material where the second basket abuts the balance ring and the compressible material is adapted to be compressed by a weight of the second basket and any liquid located therein.

3. The laundry treating appliance of claim 1 wherein the balance ring includes a rib formed along an upper periphery of the balance ring.

4. The laundry treating appliance of claim 1, further comprising a deflector operably coupled to the first basket assembly or the second basket and adapted to direct liquid radially away from the junction.

5. The laundry treating appliance of claim 1 wherein a compressible material is operably coupled to an edge of the second basket where the second basket meets with the balance ring.

6. The laundry treating appliance of claim 1 wherein the first basket further includes a top wall, the balance ring extending upwards from the top wall along a radially inner edge of the top wall.

7. The laundry treating appliance of claim 6 wherein the second basket includes a peripheral wall with a rim defining an edge at an upper periphery of the peripheral wall of the second basket.

8. The laundry treating appliance of claim 7 wherein, when the second basket is received within the at least a portion of the first treating chamber, the rim rests on the balance ring and the peripheral wall is radially spaced from the balance ring, the interface seal provided at the interface defined where the rim of the second basket and the balance ring of the first basket assembly meet.

9. The laundry treating appliance of claim 1 wherein the interface seal is provided at the interface defined where the second basket and the balance ring of the first basket assembly meet and wherein the interface seal impedes contamination between the first and second wash environments.

10. A laundry treating appliance comprising:

a first basket assembly including a first basket defining a first treating chamber for receiving laundry for treatment in a first wash environment and a balance ring forming an upper periphery of the first basket assembly and operably coupled to the first basket, wherein an extension protrudes radially from a portion of the balance ring and at least a portion of the first basket surrounds and forms a crimp about the extension to form a junction; and a second basket selectively receivable within at least a portion of the first treating chamber where the second basket defines a second treating chamber for receiving laundry for treatment in a second wash environment and wherein when the second basket is received within the at least a portion of the first treating chamber a portion of the second basket abuts the balance ring and a sealing interface is defined where the second basket and the first basket assembly meet.

11. The laundry treating appliance of claim 10 wherein a gasket is provided at the junction between the first basket and the balance ring.

12. The laundry treating appliance of claim 11 wherein the gasket includes a hot-melt silicone gasket.

13. The laundry treating appliance of claim 10 wherein the balance ring or the second basket include a compressible material where the second basket abuts the balance ring and the compressible material is adapted to be compressed by a weight of the second basket and any liquid located therein.

14. The laundry treating appliance of claim 10 wherein the balance ring includes a rib formed along an upper periphery of the balance ring.

15. The laundry treating appliance of claim 10, further comprising a deflector operably coupled to the first basket assembly or the second basket and adapted to direct liquid radially away from the junction.

16. The laundry treating appliance of claim 10 wherein a compressible material is operably coupled to an edge of the second basket where the second basket meets with the balance ring.

17. The laundry treating appliance of claim 10 wherein the first basket further includes a top wall, the balance ring extending upwards from the top wall along a radially inner edge of the top wall.

18. The laundry treating appliance of claim 17 wherein the second basket includes a peripheral wall with a rim defining an edge at an upper periphery of the peripheral wall of the second basket.

19. The laundry treating appliance of claim 18 wherein, when the second basket is received within the at least a portion of the first treating chamber, the rim rests on the balance ring and the peripheral wall is radially spaced from the balance ring, the interface seal provided at the interface defined where the rim of the second basket and the balance ring of the first basket assembly meet.

20. The laundry treating appliance of claim 10 wherein an interface seal is provided at the interface defined where the second basket and the balance ring of the first basket assembly meet and wherein the interface seal impedes contamination between the first and second wash environments.

* * * * *